US006887117B2

(12) United States Patent
Varney et al.

(10) Patent No.: US 6,887,117 B2
(45) Date of Patent: May 3, 2005

(54) PUMP JET WITH AN EXHAUST BYPASS AND ASSOCIATED METHODS

(75) Inventors: A. Michael Varney, Winter Park, FL (US); John D. Martino, Longwood, FL (US); Kimball P. Hall, Wading River, NY (US)

(73) Assignee: Applied Combustion Technology, Inc., Orlando, FL (US)

( * ) Notice: Subject to any disclaimer, the term of this patent is extended or adjusted under 35 U.S.C. 154(b) by 0 days.

(21) Appl. No.: 10/772,961

(22) Filed: Feb. 5, 2004

(65) Prior Publication Data

US 2004/0157512 A1 Aug. 12, 2004

Related U.S. Application Data

(60) Provisional application No. 60/446,138, filed on Feb. 10, 2003.

(51) Int. Cl.[7] ..... B63H 21/32
(52) U.S. Cl. ..... 440/89 A
(58) Field of Search ..... 440/89 A, 89 R, 440/38; 60/221

(56) References Cited

U.S. PATENT DOCUMENTS

| | | | | |
|---|---|---|---|---|
| 3,044,259 | A | 7/1962 | Tuttle | 60/35.54 |
| 3,249,083 | A | 5/1966 | Irgens | 115/12 |
| 3,389,558 | A | 6/1968 | Hall | 60/221 |
| 3,849,982 | A | 11/1974 | Hall | 60/221 |
| 3,871,324 | A | 3/1975 | Snyder | 115/17 |
| 4,023,353 | A | 5/1977 | Hall | 60/221 |
| 4,027,407 | A | 6/1977 | Kiss | 37/61 |
| 4,631,032 | A | 12/1986 | Nishida | 440/47 |
| 4,802,872 | A | 2/1989 | Stanton | 440/89 |
| 5,145,428 | A | 9/1992 | Harrison | 440/89 |
| 5,273,467 | A | 12/1993 | Hall | 440/89 |
| 5,325,662 | A | 7/1994 | Varney et al. | 60/221 |
| 5,389,020 | A | 2/1995 | Clark | 440/67 |
| 5,389,021 | A | 2/1995 | Padgett | 440/67 |
| 5,597,245 | A | 1/1997 | Meyerhoff | 440/67 |
| 5,857,880 | A | 1/1999 | Harada | 440/89 |
| 6,168,485 | B1 | 1/2001 | Hall et al. | 440/89 |
| 6,190,218 | B1 | 2/2001 | Hall et al. | 440/67 |
| 6,224,434 | B1 | 5/2001 | Varney et al. | 440/38 |

*Primary Examiner*—Ed Swinehart
(74) *Attorney, Agent, or Firm*—Allen, Dyer, Doppelt, Milbrath & Gilchrist, P.A.

(57) ABSTRACT

A marine outboard motor includes a power unit and a pump jet. The power unit includes a drive output and an exhaust outlet, and the pump jet includes a rotor hub and a rotor carried thereby. The rotor hub is connected to the drive output of the power unit for selective rotation for forward or reverse motion, and the rotor hub has an internal passageway connected in fluid communication with the exhaust outlet. The pump jet further includes an exhaust bypass movable between normal and bypassed positions. The exhaust bypass when in the normal position directing exhaust through the internal passageway of the rotor hub to discharge downstream of the rotor during forward motion. The exhaust bypass when in the bypassed position bypassing exhaust from the internal passageway to discharge downstream of the rotor during reverse motion.

42 Claims, 8 Drawing Sheets

PUMP JET WITH AN EXHAUST BYPASS AND ASSOCIATED METHODS

RELATED APPLICATION

This application is based upon prior filed provisional application Ser. No. 60/446,138 filed Feb. 10, 2003, the entire disclosure of which is incorporated herein by reference.

FIELD OF THE INVENTION

The present invention relates to the field of marine outboard motors, and more particularly, to a pump jet for a marine outboard motor.

BACKGROUND OF THE INVENTION

In a conventional marine outboard motor, a propeller is driven by a drive output of the motor to propel a boat through the water. Most large outboard motors of this type inject the exhaust under water to reduce engine noise and increase propulsive thrust. The exhaust generated by the motor flows downwardly through an exhaust channel and exits the motor through the propeller. This type of motor is referred to as an exhaust-through-the-hub (ETH) motor.

When the drive output rotates the propeller for forward motion, the exhaust is discharged downstream of the propeller. In contrast, when the drive output rotates the propeller for reverse motion, the exhaust is discharged such that it can be entrained into the propeller. Even though the exhaust intrudes into the water stream being moved by the propeller in reverse motion, a high reverse thrust level is possible since the propeller is not surrounded by a housing.

Another type of conventional outboard motor has a pump jet driven by the drive output. In a pump jet, an impeller or rotor is mounted directly to the drive output in place of the propeller, and a ducted housing surrounds the rotor. Modifications to the gear case, cooling or sealing components of the motor are typically not required for a pump jet. Benefits of a pump jet include reducing hazards to swimmers in the vicinity of the motor, protecting the rotor from interference with and damage by foreign objects in the water, and improving the efficiency and performance of the motor. Another benefit inherent with a pump jet is a greater steering response based upon a directed jet of water resulting therefrom.

As with a propeller, when the drive output rotates the rotor for forward motion, the exhaust is discharged downstream of the rotor. Unfortunately, in reverse motion, the exhaust may enter the water stream within the housing and little or no reverse level thrust is achieved. The Applicants provided one approach to this problem, as disclosed in U.S. Pat. No. 5,325,662.

In the '662 patent, exhaust from a power unit 11 flows downwardly through an exhaust channel 12 and through the rotor hub 55 into an exhaust plenum 44, as illustrated in FIG. 1. At least one hollow stator vane 50*a* extends radially from the exhaust plenum 44, and the exhaust is discharged through the stator vane. Since the exhaust is radially discharged outwardly through an exhaust port 64 in the wall of a stator housing 28, the exhaust will not enter the water stream when the pump jet 40 is in reverse motion.

Due to the practical need to discharge large volumes of exhaust at wide open throttle, a plurality of hollow stator vanes 50*a*, 50*b* are required. The pump jet area blockage associated with a plurality of stator vanes 50*a*, 50*b* directly competes with the available internal water flow area required by the pump jet 40 to produce acceptable thrust levels. Exhaust systems relying on radial exhaust discharge through hollow stator vanes are difficult to design and fabricate with acceptable propulsive performance.

SUMMARY OF THE INVENTION

In view of the foregoing background, it is therefore an object of the present invention to provide a pump jet for a marine outboard motor that provides high thrust levels in both forward and reverse motions without restricting the water flow therethrough.

This and other objects, advantages and features in accordance with the present invention are provided by a marine outboard motor comprising a power unit comprising a drive output and an exhaust outlet, and a pump jet comprising a rotor hub and a rotor carried thereby. The rotor hub may be connected to the drive output of the power unit for selective rotation for forward or reverse motion, and the rotor hub may have an internal passageway connected in fluid communication with the exhaust outlet.

The pump jet may further comprise an exhaust bypass movable between normal and bypassed positions. The exhaust bypass when in the normal position directs exhaust through the internal passageway of the rotor hub to discharge downstream of the rotor during forward motion, and the exhaust bypass when in the bypassed position bypasses exhaust from the internal passageway to discharge downstream of the rotor during reverse motion. Since the exhaust is discharged downstream of the rotor in reverse motion, the pump jet in accordance with the present invention advantageously provides efficient reverse engine performance that is not deteriorated with the intrusion of unwanted exhaust.

The pump jet in accordance with the present invention has the benefits of combining the advantages of an axial flow marine pump jet with a high performance exhaust-thru-the-hub outboard motor assembly, without compromising forward, neutral and reverse engine performance. These benefits are achieved by the use of a centerbody central exhaust discharge with an exhaust bypass. The pump jet thus provides the capability to discharge large volumes of engine exhaust over a broad range of engine rotational speeds (rpm) without compromising the passage design for streamlined water flow through its interior and around its exterior. This assures that a high propulsive efficiency pump jet can be developed for large horsepower motors.

The exhaust bypass is preferably self-set to the normal position based upon rotation of the rotor hub for forward motion, and to the bypassed position based upon rotation of the rotor hub for reverse motion. The exhaust bypass may comprise an outer sleeve having a plurality of spaced apart exhaust windows therethrough, and an inner sleeve having a plurality of spaced apart exhaust windows therethrough. The exhaust bypass is in the normal position when the spaced apart exhaust windows are non-overlapping, and is in the bypassed position when the exhaust windows are overlapping.

The outer sleeve may be stationary and the inner sleeve may rotate for placing the exhaust bypass in the normal or bypassed position. The outer sleeve may further include at least one slot, and the inner sleeve may comprise at least one pin extending outwardly therefrom and into the at least one slot. The exhaust bypass is in the normal or bypassed position based upon rotation of the at least one pin in the at least one slot.

The drive output comprises a rotor shaft extending outwardly from the power unit and through the exhaust bypass for engaging the rotor hub. In one embodiment of the rotor hub and the exhaust bypass, the rotor hub includes an outer end surface with a circular groove therein, and the inner sleeve includes a circularly shaped protruding end that is received by the groove in the rotor hub. Rotation of the rotor hub causes the inner sleeve to rotate based upon a viscous friction therebetween.

In another embodiment of the rotor hub and the exhaust bypass, the rotor hub further comprises a lever pivotally connected in the internal passageway thereof and has a first end for engaging the inner sleeve, and rotation of the rotor hub causes the inner sleeve to rotate. The lever also has a second end so that rotation of the rotor hub above a predetermined speed causes the first end to disengage the inner sleeve. The lever may be under compression so that the first end thereof engages the inner sleeve.

The pump jet may further comprise a rotor housing surrounding the rotor hub, the rotor and the exhaust bypass. A stator housing may be connected to the rotor housing and may comprise a stator hub having an internal passageway connected in fluid communication with the internal passageway of the rotor hub. The marine outboard motor may further comprise a housing for carrying the power unit, and the housing may include a mounting plate (i.e., an anti-cavitation plate) extending above the pump jet. The stator housing may further comprise a dorsal fin extending therefrom for securing the pump jet to the mounting plate. Since the stator housing typically has a larger surface area than the rotor housing, attachment of the pump jet to the mounting plate via the dorsal fin on the stator housing provides a significantly larger structural load path for absorbing the loads generated by high horsepower pump jets. Previous attachment methods utilized the rotor housing, which was restricted in size because of the smaller surface area available with respect to the size of the rotor housing.

Nonetheless, the rotor housing may also comprise a dorsal fin extending therefrom for securing the pump jet to the mounting plate. This may be in addition to the dorsal fin on the stator housing. In addition, the marine outboard motor further comprises a skeg, and a clamp for securing the rotor housing to the skeg.

Another aspect of the present invention is directed to a method for discharging exhaust from a pump jet for a marine outboard motor as described above. The method comprises placing the exhaust bypass in the normal position during forward motion for directing exhaust through the internal passageway of the rotor hub for discharging downstream of the rotor, and placing the exhaust bypass in the bypassed position during reverse motion for bypassing exhaust from the internal passageway for discharging downstream of the rotor during reverse motion.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

A pump jet for a marine outboard motor in accordance with the present invention will now be discussed. Example marine outboard motors are manufactured by Evinrude and Johnson Motors (Bombardier Recreational Products Incorporated) and Mercury Marine, Inc. (a subsidiary of Brunswick Corporation). In alternative embodiments, an inboard motor could be substituted for the outboard motor, as readily appreciated by those skilled in the art. For purposes of illustrating the present invention, discussion will be directed toward a marine outboard motor.

Figure 1:
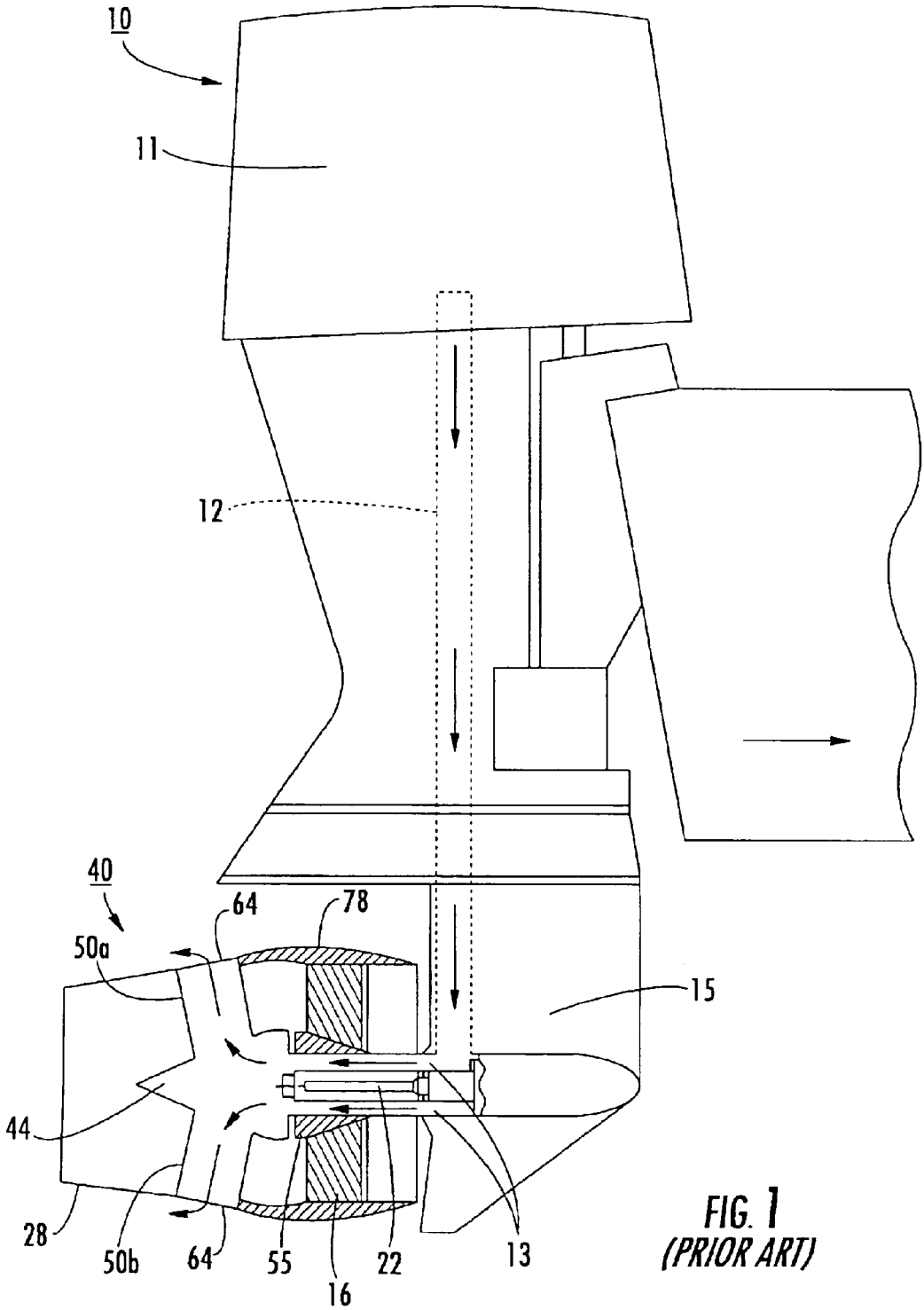
FIG. 1 (PRIOR ART)
FIG. 1 is a partial cross-sectional view of a marine outboard motor in which exhaust is discharged through at least one stator vane in the pump jet in accordance with the prior art.

Referring again to FIG. 1, a conventional marine outboard motor 10 with a pump jet 40 comprises a power unit 11 including a drive output 22 and an exhaust outlet 13. The drive output 22 is a propeller shaft extending from a gear case 15 that is part of the power unit 11. In the pump jet 40, an impeller or rotor 16 is mounted (e.g., spline fitted) directly on the propeller shaft 22 in place of a propeller. The gear case 15 places the rotor 16 in forward or reverse motion, or in a neutral position. A rotor housing 78 and a stator housing 28 surrounds the rotor 16.

Figure 2:
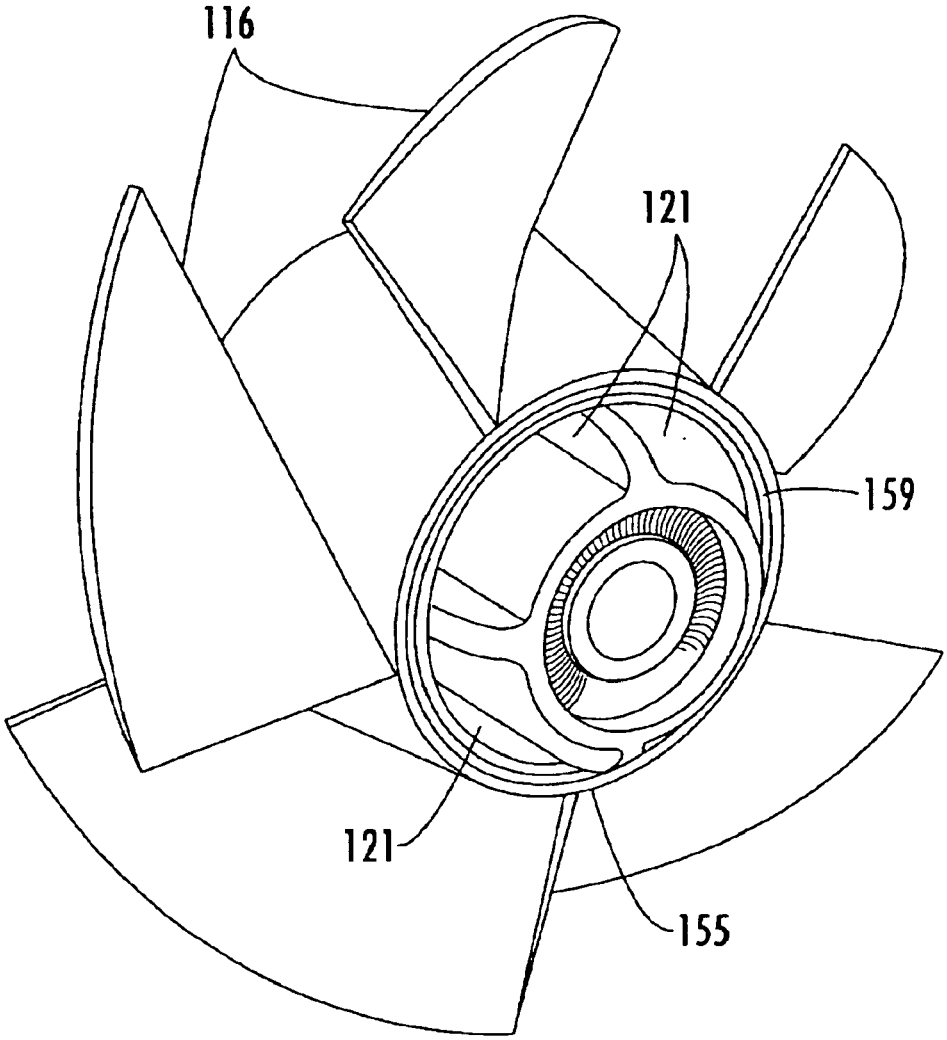
FIG. 2 is a perspective view of a rotor hub and a rotor carried thereby in accordance with the present invention.

The pump jet 140 in accordance with the present invention will now be discussed with reference to FIGS. 2–4. The pump jet 140 comprises a rotor hub 155 and a rotor 116 carried thereby, as illustrated in FIG. 2. The rotor hub 155 is connected to the drive output 122 for selective rotation for forward or reverse motion. The rotor hub 155 has an internal passageway 121 connected in fluid communication with the exhaust outlet 113. In one embodiment, the internal passageway 121 is a segmented annulus within the rotor hub 155, as shown in FIG. 2.

The pump jet 140 further comprises an exhaust bypass 130 that is movable between normal and bypassed positions. The exhaust bypass 130 is positioned between the gear case 115 and the rotor hub 155. In particular, the drive output 122 from the gear case 115 extends through the exhaust bypass 130 and into the rotor hub 155.

Figure 3:
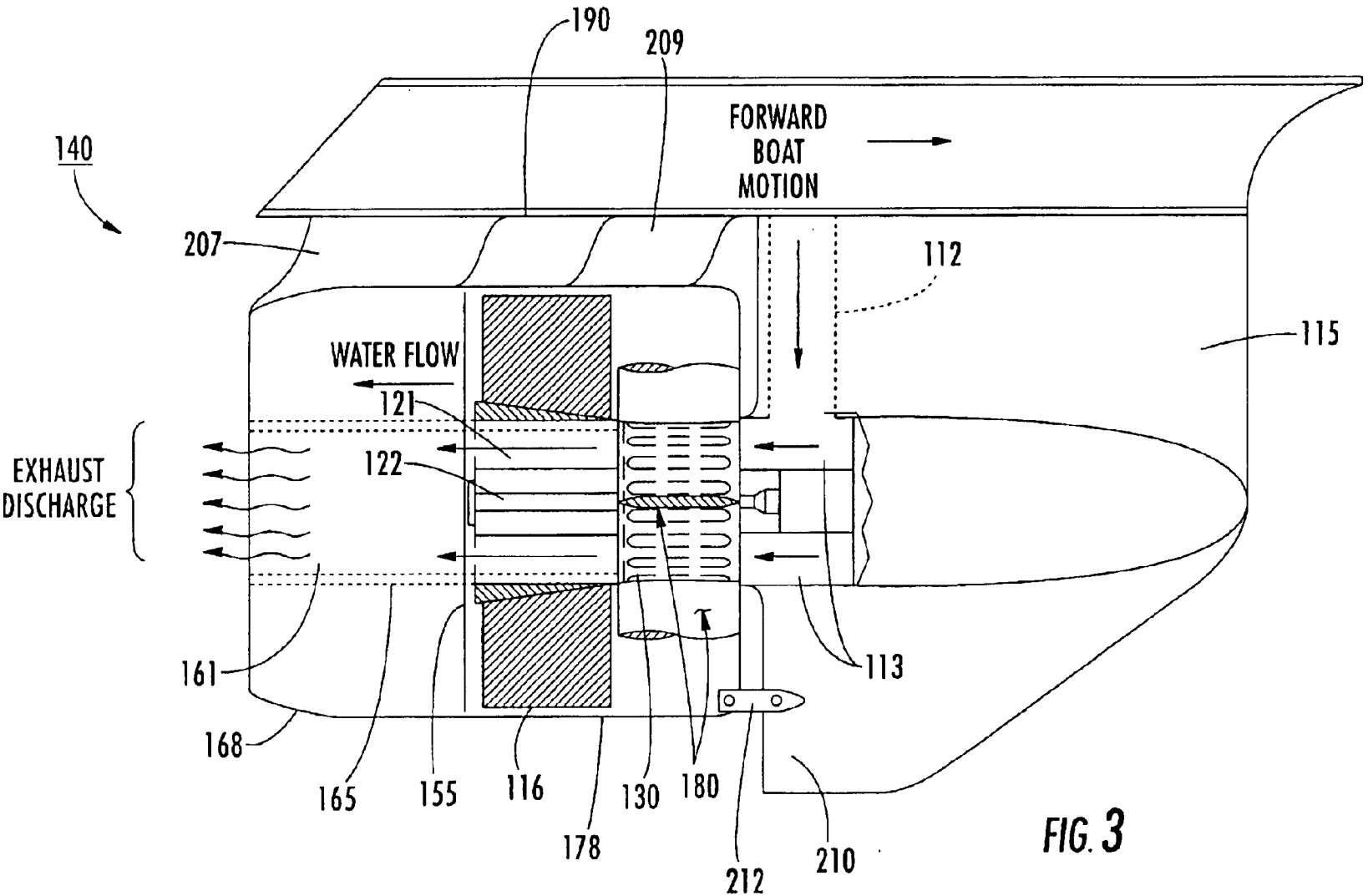
FIG. 3 is a partial cross-sectional view of a pump-jet in accordance with the present invention in which exhaust is being discharged downstream of the rotor in forward boat motion.
Figure 4:
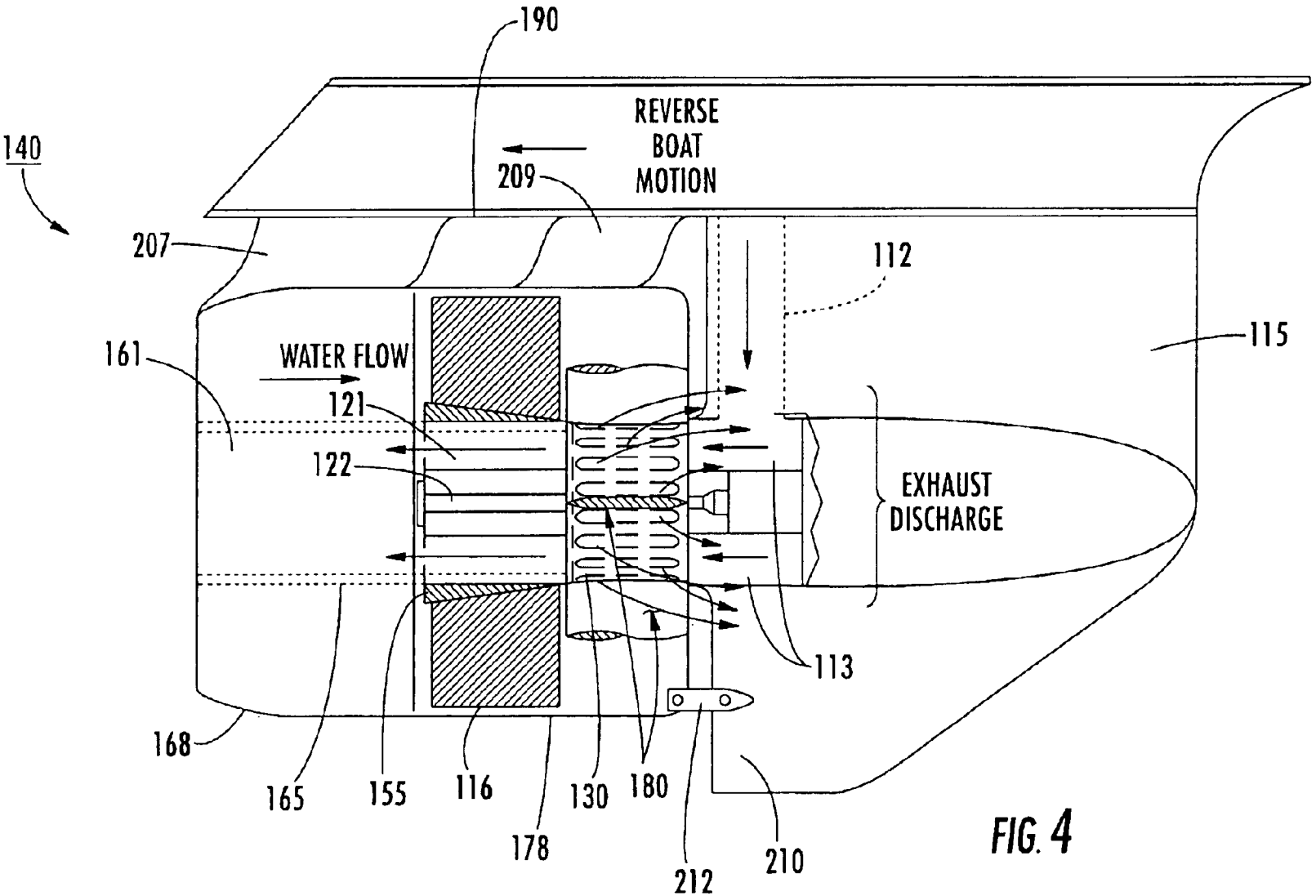
FIG. 4 is a partial cross-sectional view of a pump-jet in accordance with the present invention in which exhaust is being discharged downstream of the rotor in reverse boat motion.

When the exhaust bypass 130 is in the normal position, exhaust is directed through the internal passageway 121 of the rotor hub 155 for discharging downstream of the rotor 116 during forward motion, as illustrated in FIG. 3. When the exhaust bypass 130 is in the bypassed position, exhaust is bypassed from the internal passageway 121 for discharging downstream of the rotor 116 during reverse motion, as illustrated in FIG. 4.

Figure 5A:
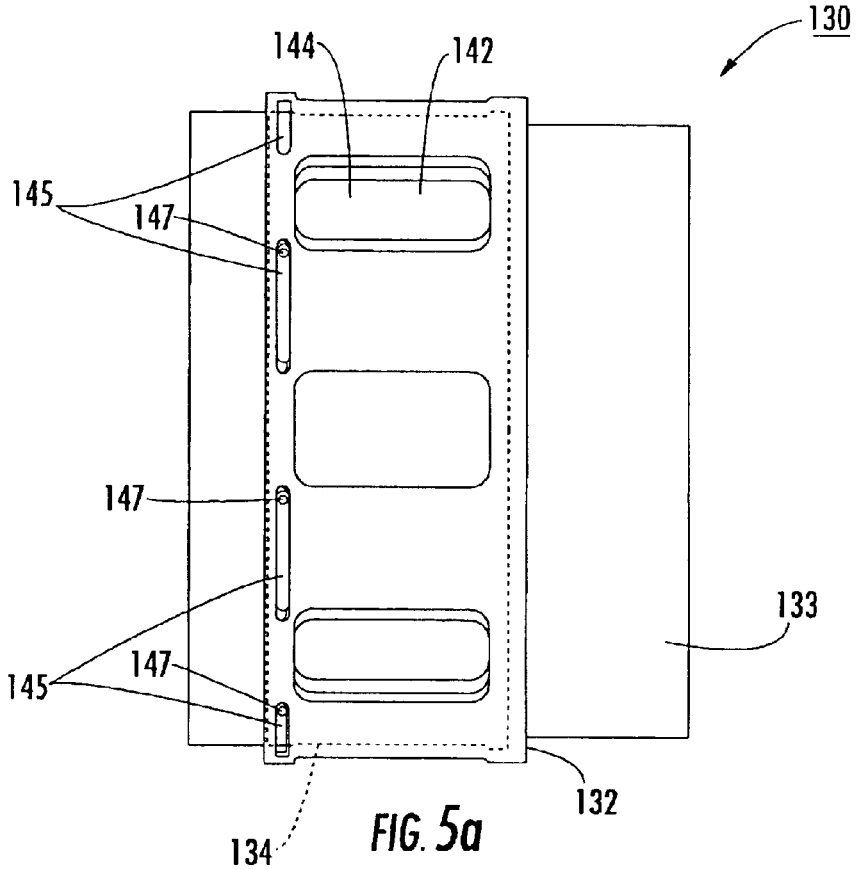
FIG. 5*a* is a side view of the exhaust bypass in accordance with the present invention.

As will now be discussed in greater detail, the exhaust bypass 130 as illustrated in FIG. 5*a* is self-set or self-actuated to the normal position based upon rotation of the rotor hub 155 for forward motion, and to the bypassed position based upon rotation of the rotor hub for reverse motion. In other words, the exhaust bypass 130 does not require any external control linkage connected thereto to be placed in the normal or bypassed positions.

Figure 5B:
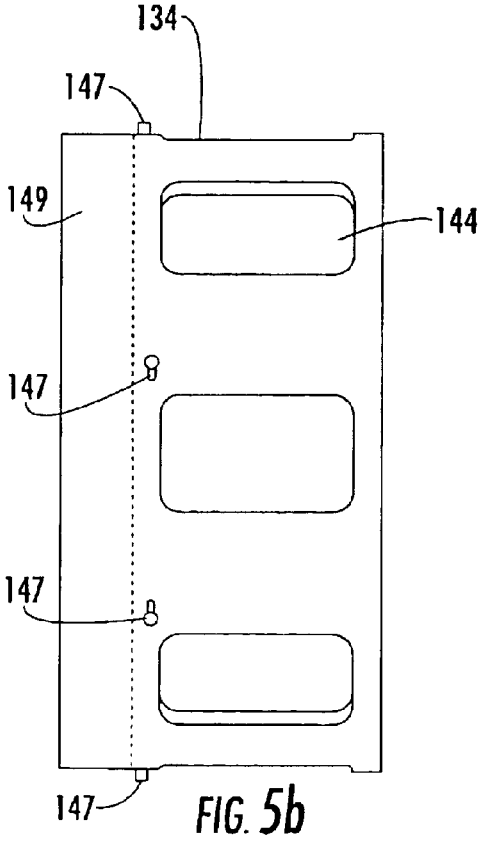
FIGS. 5*b* and 5*c* are respective side views of the inner sleeve and the outer sleeve of the exhaust bypass in accordance with the present invention.
Figure 5C:
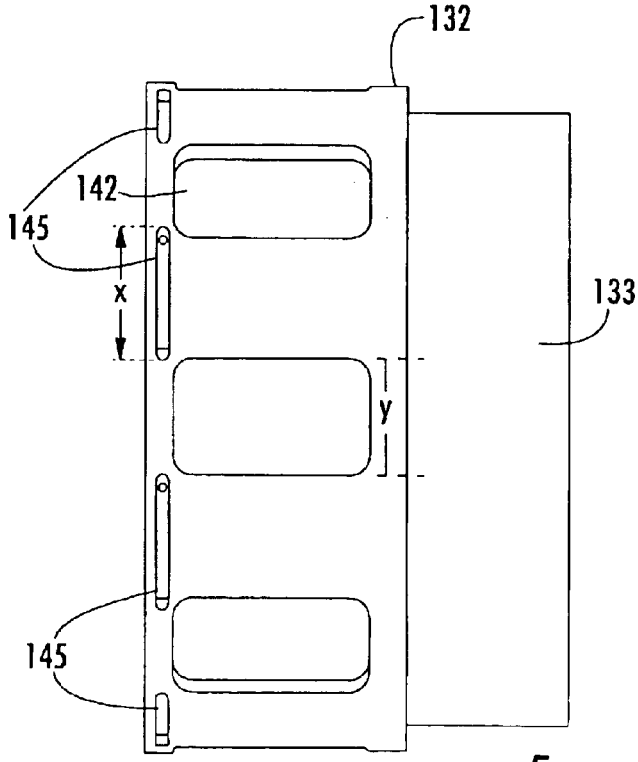
Figure 6A:
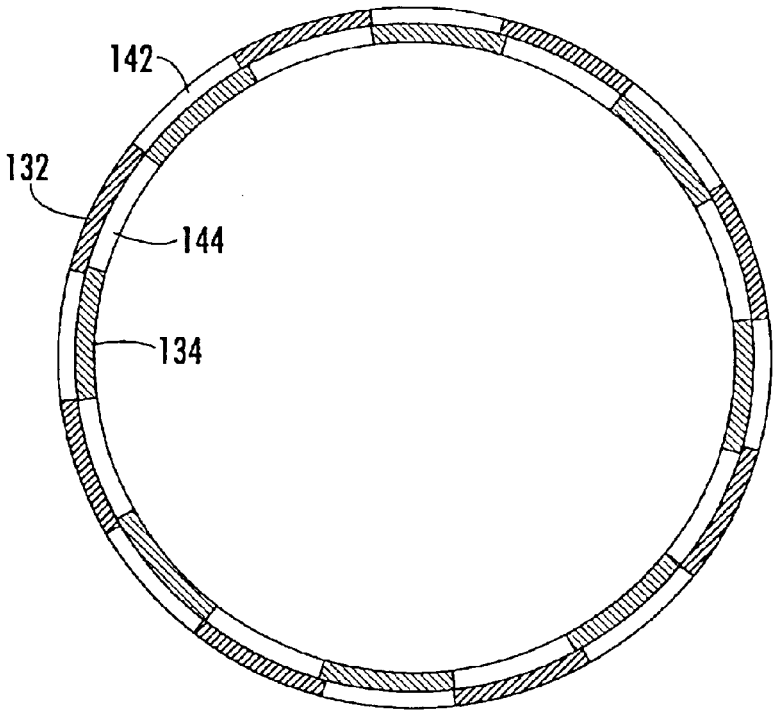
FIGS. 6*a* and 6*b* are respective end views of the exhaust bypass in the normal position and in the bypassed position in accordance with the present invention.
Figure 6B:
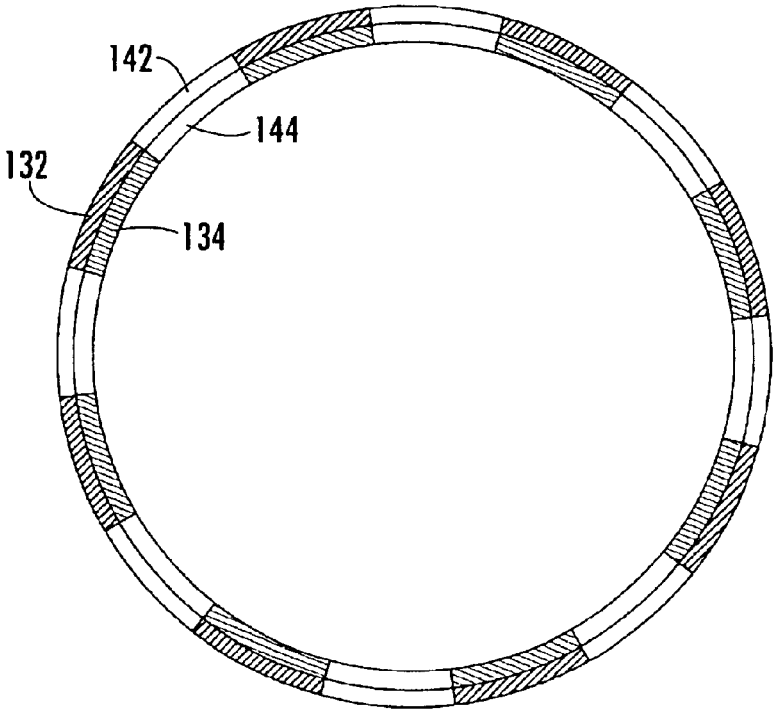

The exhaust bypass 130 comprises an inner sleeve 134 having a plurality of spaced apart exhaust windows 144 therethrough, and an outer sleeve 132 also having a plurality of spaced apart exhaust windows 142 therethrough, as respectively illustrated in FIGS. 5*b* and 5*c*. Both of the inner and outer sleeves 132, 134 are cylindrical in shape, and an outer surface of the exhaust bypass 130 (i.e., the outer sleeve 132) is substantially aligned with an outer surface of the rotor hub 155. The exhaust bypass 130 is in the normal position when the spaced apart exhaust windows 142, 144 are non-overlapping (FIG. 6*a*), and is in the bypassed position when the exhaust windows are overlapping (FIG. 6*b*).

The inner and outer sleeves 132, 134 may be constructed from steel, aluminum or plastic, for example. Moreover, the inner and outer sleeves 132, 134 may be made from different materials. For example, the outer sleeve 132 may be heat-treated aluminum or stainless steel, whereas the inner sleeve 134 may be an aluminum casting or a molded plastic part. However, other materials may be used as readily appreciated by those skilled in the art.

In the illustrated embodiment of the exhaust bypass 130, the outer sleeve 132 is stationary and the inner sleeve 134 rotates for placing the exhaust bypass in the normal or bypassed position. The outer sleeve 132 includes an extension 133 that is connected to the gear case 115 adjacent the drive output 122. The outer sleeve 132 is also connected to the rotor housing 178 via a plurality of rotor housing hub struts 180, as illustrated in FIGS. 3 and 4.

The outer sleeve 132 further includes at least one slot 145 having spaced apart ends. In the illustrated embodiment, there are a plurality of spaced apart slots 145 along an edge of the outer sleeve 132. The length x of each slot 145 is approximately equal to width y of the exhaust windows 142, 144.

The inner sleeve 134 comprises at least one stop pin 147 extending outwardly therefrom and into the at least one slot 145. In the illustrated embodiment, there are a plurality of spaced apart stop pins 147 corresponding to the plurality of slots 145. The width of each slot 145 is slightly larger than a diameter of each stop pin 147. The stop pins 147 may be spring pins pressed into predrilled hole locations, as readily appreciated by those skilled in the art.

When the stop pins 147 are inserted into their respective slots 145, the inner sleeve 134 is located axially relative the outer sleeve 132. The length x of the slots 145 in the circumferential direction limits the circumferential rotation of the inner sleeve 134 relative to the fixed outer sleeve 132 to a small angle between the normal position and the bypassed position of the exhaust bypass 130. The angle may be within 5 to 15 degrees, for example.

As discussed above, the exhaust bypass 130 is self-set or self-actuated to the normal position based upon rotation of the rotor hub 155 for forward motion, and to the bypassed position based upon rotation of the rotor hub for reverse motion. In one embodiment, this is accomplished as a result of the hydrodynamic forces generated by rotation of the rotor hub 155, which is transferred to the inner sleeve 134 via viscous friction therebetween.

More particularly, the inner sleeve 134 includes a protruding edge or lip 149, and the rotor hub 155 has a corresponding groove 159 (FIG. 2) machined therein for receiving the protruding edge during assembly. For a 50 to 75 horsepower outboard motor, the protruding edge 149 protrudes about a half inch to provide positive opening and closing forces. Rotation of the rotor hub 155 thus causes the inner sleeve 134 to rotate based upon the viscous friction therebetween. A corresponding depth of the groove 159 is about 1/16 to 1/8 inch to insure that the groove can rotate at full operational speed without damaging the protruding edge 149 from the inner sleeve 134.

When the rotor hub 155 is rotating so that the boat is moving in a forward motion, the viscous friction between the protruding edge 149 and the groove 159 causes the inner sleeve 134 to rotate until the stop pins 147 rest against a first end of a corresponding slot 145. Rotation of the inner sleeve 134 in the forward motion causes the exhaust windows 144 thereof to be non-overlapping with the exhaust windows 142 in the outer sleeve 132, as best shown in FIG. 6*a*.

This is the normal position of the bypass exhaust 130 so that exhaust is directed through the internal passageway 121 of the rotor hub 155. The exhaust from the internal passageway 121 of the rotor hub 155 is further directed through another passageway or plenum 161 extending through a stator housing 168 connected to the rotor housing 178. The passageway 161 of the stator housing 168 is in fluid communication with the passageway 121 through the rotor hub 155. In effect, the passageway 161 through the stator housing 168 serves as an exhaust tailpipe for the pump jet 140 in forward motion.

Likewise, when the rotor hub 155 is rotating so that the boat is moving in a reverse motion, the viscous friction between the protruding edge 149 and the groove 159 causes the inner sleeve 134 to rotate until the stop pins 147 rest against a second end of a corresponding slot 145. Rotation of the inner sleeve 134 in the reverse motion causes the exhaust windows 144 thereof to be overlapping with the exhaust windows 142 in the outer sleeve 132, as best shown in FIG. 6*b*.

This is the bypassed position of the bypass exhaust 130 so that exhaust is directed from the exhaust outlet 113 through the exhaust windows 142, 144 instead of through the internal passageway 121 of the rotor hub 155. Elevated water pressure in the passageway 161 through the stator housing 168 is created by the reverse motion, and this causes the exhaust to discharge through the exhaust windows 142, 144 so that the water flow direction and the exhaust flow direction out of the pump jet 140 are the same in the reverse motion. Consequently, the exhaust is prevented from intruding into the pump jet water stream and a high reverse thrust level is possible.

The exhaust windows 142, 144 in the inner and outer sleeves 132, 134 are preferably sized so that they exceed the exhaust-through-the-hub rotor area by at least a factor of 1.5 to insure that the exhaust flow easily passes through the exhaust windows. As noted above, the length x of the slots 145 controls the time to go from the normal position of the exhaust bypass 130 to the bypassed position, and the length is preferably selected to minimize or reduce the time for unacceptable exhaust blow-by to occur at low to mid-range motor operations. As also noted above, the length x also determines the angle through which the inner sleeve 134 rotates.

Another embodiment of the rotor hub 155' and the exhaust bypass 130' will now be discussed with reference to FIGS. 7, 8*a* and 8*b*. An inner surface of the exhaust bypass 130' is substantially aligned with the internal passageway 121' of the rotor hub 155'. The rotor hub 155' further comprises a lever 200' pivotally connected in the internal passageway 121'. The lever 200' is used to rotate the inner sleeve 132' to the normal or bypassed position. The lever 200' has a first end 202' forceably engaging the inner surface of the inner sleeve 134'.

When the rotor hub 155' rotates in the forward or reverse motion, the inner sleeve 134' rotates until the pins 147' contact the first or second ends of the slots 145'. The lever 200' also has a weighted second end 204' causing the first end to disengage the inner surface of the inner sleeve based upon rotation of the rotor hub 155' exceeding a predetermined speed.

The lever 200' is a see-saw type actuator arrangement. The outer sleeve 132' is thin walled and is the rigid portion of the bypass exhaust 130', and is attached to the stationary rotor housing 178' to prevent movement. The inner sleeve 134' is thick walled and is constrained, but is free to rotate within the outer sleeve 132' within an angle defined by the length x' of the slots 145'.

Both the outer and inner sleeves 132', 134' include exhaust windows 142', 144' extending therethrough. The exhaust windows 142', 144' are not limited to any particular orientation or shape as long as they are non-overlapping or not aligned with respect to one another when the exhaust bypass 130' is in the normal position for forward motion, and they are overlapping or aligned with respect to one another when the exhaust bypass is in the bypassed position for reverse motion. Of course, the exhaust windows 142', 144' are preferably sized so that they exceed the exhaust-through-the-hub rotor area by at least a factor of 1.5 to insure that the exhaust flow easily passes through the exhaust windows.

Figure 7:
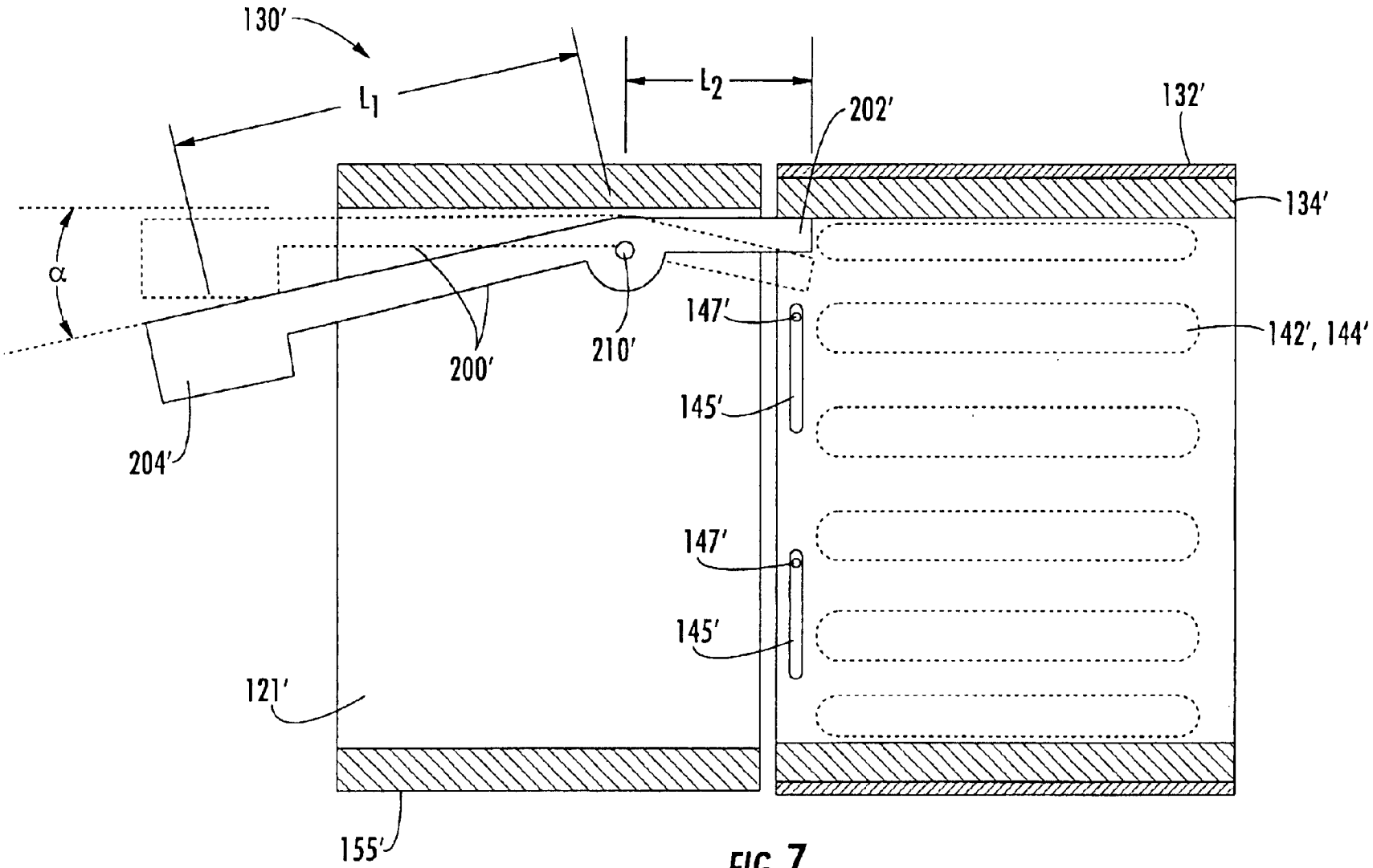
FIG. 7 is an enlarged, partial cross-sectional view of another embodiment of the rotor hub and exhaust bypass in accordance with the present invention.
Figure 8A:
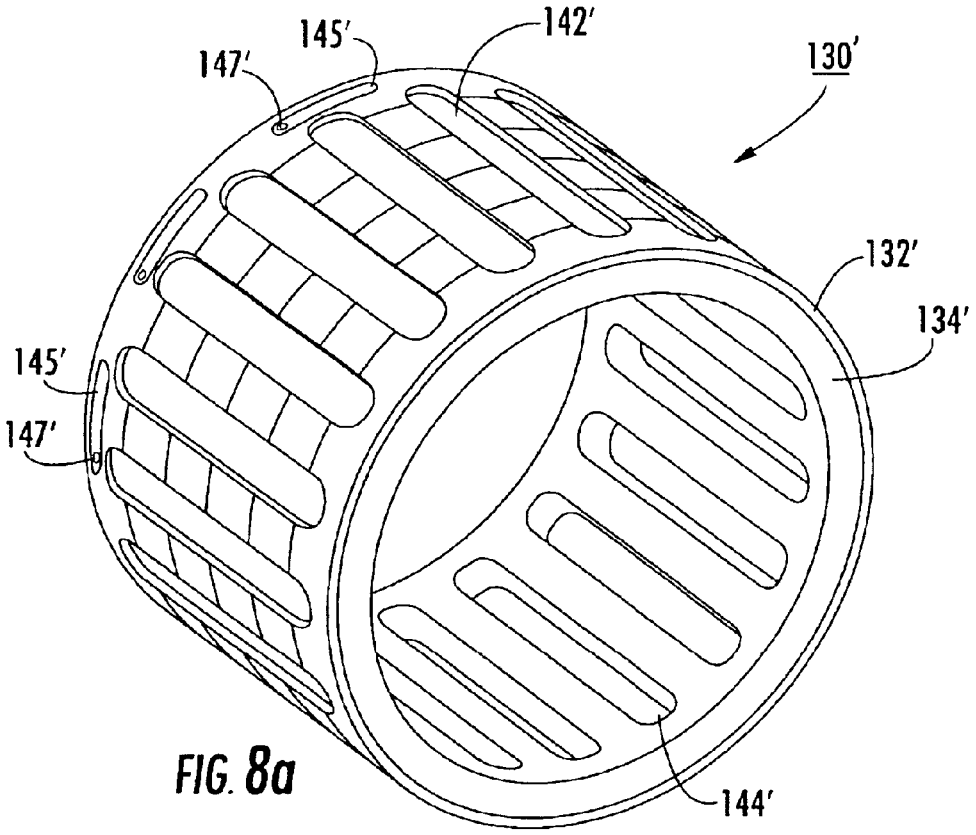
FIGS. 8*a* and 8*b* are respective perspective views of the exhaust bypass as shown in FIG. 7 in the normal position and in the bypassed position.
Figure 8B:
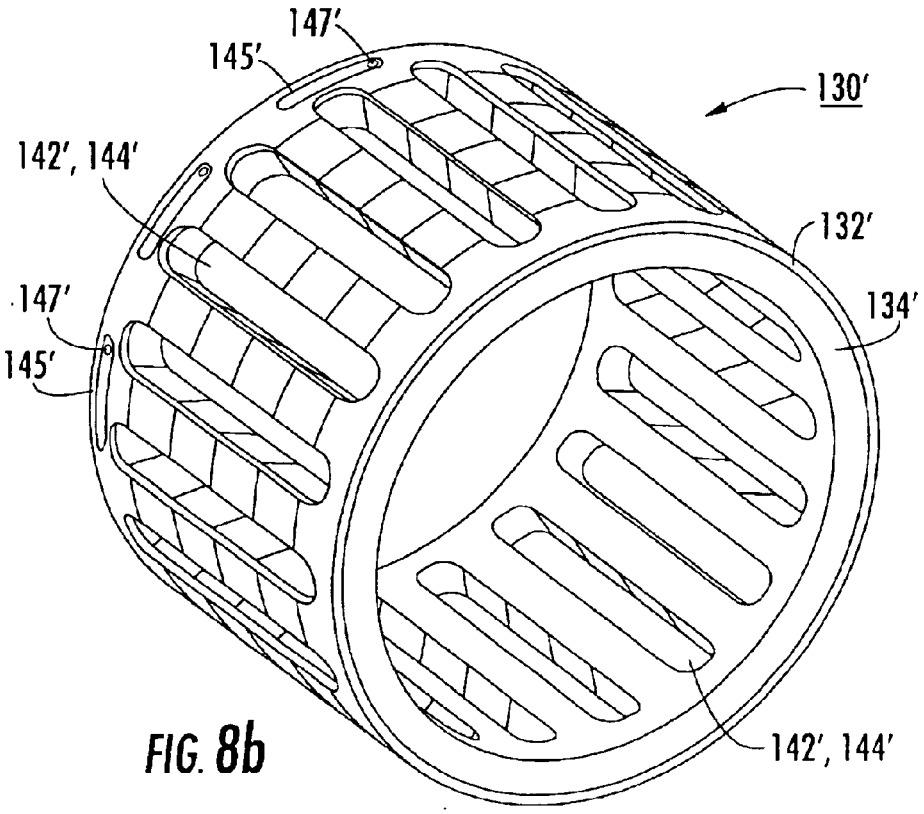

As illustrated in FIG. 7, the see-saw lever 200' is a canted lever that is attached to the rotor hub 155' using a suitable pin 210' causing the lever to rotate with the rotor 116' about an axis of the drive output. The lever 200' is also permitted to pivot about the attachment pin 210'. The second end 204' of the lever 200' includes a counter-weight that is a distance L1' from the attachment pin 210'. The first end 202' of the lever 200' is a friction surface end that is a distance L2' from the attachment pin 210'.

A normal resting position of the lever 200' is shown in FIG. 7 when the outboard motor is in neutral or at low operating speeds. In the resting position, the friction surface end 202' is in contact with the inner surface of the inner sleeve 134', either naturally or by a suitably installed spring device.

When the engine gear selector places the gear case 115' in reverse, the inner sleeve 134' rotates counter-clockwise by the lever 200' that is attached to the rotor 116', thereby placing the exhaust bypass 130' in the bypassed position, i.e., the exhaust windows 142', 144' are overlapping. As the reverse engine speed increases, the rotational inertial force acting through the centroid of the counter-weighted forces on the second end 204' forces the lever 200' to move away from the inner sleeve 134' through an angle $\alpha$ based upon the length x of the slots 145', thereby disengaging the first end 202' of the lever 200' from the inner sleeve 134'. This position is shown by the dashed outline of the lever 220' in FIG. 7.

After reverse motion is completed, the engine is placed in neutral, thereby diminishing the rotation inertial forces and allows the friction surface of the first end 202' to come in contact with the inner surface of the inner sleeve 134'. When the forward gear is selected, the inner sleeve 134' is rotated clockwise by the friction surface of the lever 200', thereby placing the exhaust bypass 130' in a normal position. As the forward engine speed increases, the rotational inertial force acting through the second end 204' forces the lever 200' to move away from the inner sleeve 134', thereby disengaging the first end 202' from the inner sleeve 134'.

Referring back to FIGS. 3 and 4, the rotor housing 178 encloses the rotor hub 155, the rotor 116 and the exhaust bypass 121. The stator housing 168 is connected to the rotor housing 178 and includes a stator hub 165 having an internal passageway 161 connected in fluid communication with the internal passageway 121 of the rotor hub 155.

The marine outboard motor has an anticavitation plate 190 used by the pump jet 140 to attach thereto. The stator housing 168 comprises a dorsal fin 207 extending therefrom for securing the pump jet 140 to the anticavitation plate 190. The rotor housing 178 also comprises a dorsal fin 209 extending therefrom for securing the pump jet 140 to the anticavitation plate 190. The marine outboard motor also comprises a skeg 210, and a clamp 212 for securing the rotor housing 178 to the skeg.

The rotor housing 178 is positioned on the engine gearcase 115 by an alignment sleeve (not shown) that assists in locating the rotor 116 concentrically within the rotor housing. The rotor 116 is installed within the rotor housing 178, onto the propeller shaft 122 via the normal arrangement for a conventional propeller. Correct rotor 116 rotation is provided by the concentric alignment achieved between the rotor housing 155 and the gearcase alignment sleeve, which is rigidly attached to the gearcase hub body.

The stator housing 168, containing an integral dorsal fin 207 at the 12:00 position, is rigidly attached to the anti-ventilation plate 190 by bolts with adjustable positioning capability for proper alignment between the stator housing 168, the propeller shaft 122, and the rotor housing 178. The pump jet 140 becomes an integral assembly by securing the stator housing 168 to the rotor housing 178 with a family of attachment screws uniformly distributed around the perimeter of the stator housing interface boundary with the rotor housing.

Since the stator housing 168 typically has a larger surface area than the rotor housing 178, attachment of the pump jet 140 to the mounting plate 190 via the dorsal fin 207 on the stator housing provides a significantly larger structural load path for absorbing the loads generated by high horsepower pump jets. Previous attachment methods utilized the rotor housing 178, which was restricted in size because of the smaller surface area available with respect to the size of the rotor housing.

Another aspect of the present invention is directed to a method for discharging exhaust from a pump jet for a marine outboard motor as described above. The method comprises placing the exhaust bypass 130, 130' in the normal position during forward motion for directing exhaust through the internal passageway 121, 121' of the rotor hub 155, 155' for discharging downstream of the rotor, and placing the exhaust bypass in the bypassed position during reverse motion for bypassing exhaust from the internal passageway for discharging downstream of the rotor during reverse motion.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A marine outboard motor comprising:

a power unit comprising a drive output and an exhaust outlet; and a pump jet comprising a rotor hub and a rotor carried thereby, said rotor hub connected to the drive output of said power unit for selective rotation for forward or reverse motion, said rotor hub having an internal passageway connected in fluid communication with the exhaust outlet, and an exhaust bypass movable between normal and bypassed positions, said exhaust bypass comprising an outer sleeve having a plurality of spaced apart exhaust windows therethrough, and an inner sleeve having a plurality of spaced apart exhaust windows therethrough, said exhaust bypass being in the normal position when the spaced apart exhaust windows are non-overlapping for directing exhaust through the internal passageway of said rotor hub to discharge downstream of said rotor during forward motion, and being in the bypassed position when the exhaust windows are overlapping for bypassing exhaust from the internal passageway to discharge downstream of said rotor during reverse motion.

2. A marine outboard motor according to claim 1 wherein said exhaust bypass is self-set to the normal position based upon rotation of said rotor hub for forward motion, and to the bypassed position based upon rotation of said rotor hub for reverse motion.

3. A marine outboard motor according to claim 1 wherein said outer sleeve is stationary, and said inner sleeve rotates for placing said exhaust bypass in the normal or bypassed position.

4. A marine outboard motor according to claim 3 wherein said outer sleeve includes at least one slot; and wherein said inner sleeve comprises at least one pin extending outwardly therefrom and into the at least one slot, said exhaust bypass being in the normal or bypassed position based upon rotation of said at least one pin in the at least one slot.

5. A marine outboard motor according to claim 3 wherein said drive output comprises a rotor shaft extending outwardly from said power unit and through said exhaust bypass for engaging said rotor hub; said rotor hub including an outer end surface with a circular groove therein, and said inner sleeve including a circularly shaped protruding end that is received by the groove in said rotor hub, and rotation of said rotor hub causes said inner sleeve to rotate based upon a viscous friction therebetween.

6. A marine outboard motor according to claim 3 wherein said drive output comprises a rotor shaft extending outwardly from said power unit and through said exhaust bypass for engaging said rotor hub; said rotor hub further comprising a lever pivotally connected in the internal passageway thereof and having a first end engaging said inner sleeve, and rotation of said rotor hub causes said inner sleeve to rotate.

7. A marine outboard motor according to claim 6 wherein said lever has a second end, and rotation of said rotor hub above a predetermined speed causes the first end to disengage said inner sleeve.

8. A marine outboard motor according to claim 6 wherein said lever is under compression so that the first end thereof engages said inner sleeve.

9. A marine outboard motor according to claim 1 wherein said pump jet further comprises:

a rotor housing enclosing said rotor hub, said rotor and said exhaust bypass; and a stator housing connected to said rotor housing and comprising a stator hub having an internal passageway connected in fluid communication with the internal passageway of said rotor hub.

10. A marine outboard motor according to claim 9 further comprising a housing for carrying said power unit, said housing including a mounting plate extending above said pump jet; and wherein said stator housing further comprises a dorsal fin extending therefrom for securing said pump jet to said mounting plate.

11. A marine outboard motor according to claim 9 further comprising a housing for carrying said power unit, said housing including a mounting plate extending above said pump jet; and wherein said rotor housing further comprises a dorsal fin extending therefrom for securing said pump jet to said mounting plate.

12. A marine outboard motor according to claim 9 further comprising a housing for carrying said power unit, said housing including a skeg; and a clamp for securing said rotor housing to said skeg.

13. A pump jet for a marine outboard motor comprising:

a rotor hub and a rotor carried thereby, said rotor hub to be connected to a drive output of the outboard motor for selective rotation for forward or reverse motion, said rotor hub having an internal passageway to be in fluid communication with an exhaust outlet of the outboard motor; and an exhaust bypass movable between normal and bypassed positions, said exhaust bypass comprising an outer sleeve having a plurality of spaced apart exhaust windows therethrough, and an inner sleeve having a plurality of spaced apart exhaust windows therethrough, said exhaust bypass being in the normal position when the spaced apart exhaust windows are non-overlapping for directing exhaust through the internal passageway of said rotor hub to discharge downstream of said rotor during forward motion, and being in the bypassed position when the exhaust windows are overlapping for bypassing exhaust from the internal passageway to discharge downstream of said rotor during reverse motion.

14. A pump jet according to claim 13 wherein said exhaust bypass is self-set to the normal position based upon rotation of said rotor hub for forward motion, and to the bypassed position based upon rotation of said rotor hub for reverse motion.

15. A pump jet according to claim 13 wherein said outer sleeve is stationary, and said inner sleeve rotates for placing said exhaust bypass in the normal or bypassed position.

16. A pump jet according to claim 15 wherein said outer sleeve includes at least one slot; and wherein said inner sleeve comprises at least one pin extending outwardly therefrom and into the at least one slot, said exhaust bypass being in the normal or bypassed position based upon rotation of said at least one pin in the at least one slot.

17. A pump jet according to claim 15 wherein the outboard motor comprises a rotor shaft extending outwardly therefrom and through said exhaust bypass for engaging said rotor hub; said rotor hub including an outer end surface with a circular groove therein, and said inner sleeve including a circularly shaped protruding end that is received by the groove in said rotor hub, and rotation of said rotor hub causes said inner sleeve to rotate based upon a viscous friction therebetween.

18. A pump jet according to claim 15 wherein the outboard motor comprises a rotor shaft extending outwardly therefrom and through said exhaust bypass for engaging said rotor hub; said rotor hub further comprising a lever pivotally connected in the internal passageway thereof and having a first end engaging said inner sleeve, and rotation of said rotor hub causes said inner sleeve to rotate.

19. A pump jet according to claim 18 wherein said lever has a second end, and rotation of said rotor hub above a predetermined speed causes the first end to disengage said inner sleeve.

20. A pump jet according to claim 18 wherein said lever is under compression so that the first end thereof engages said inner sleeve.

21. A pump jet according to claim 13 further comprising:

a rotor housing surrounding said rotor hub, said rotor and said exhaust bypass; and a stator housing connected to said rotor housing and comprising a stator hub having an internal passageway connected in fluid communication with the internal passageway of said rotor hub.

22. A pump jet according to claim 21 wherein the outboard motor comprises a housing including a mounting plate that extends above the pump jet; and wherein said stator housing further comprises a dorsal fin extending therefrom for securing said pump jet to the mounting plate.

23. A pump jet according to claim 21 wherein the outboard motor comprises a housing including a mounting plate that extends above the pump jet; and wherein said rotor housing further comprises a dorsal fin extending there from securing said pump jet to the mounting plate.

24. A method for discharging exhaust from a pump jet for a marine outboard motor comprising a power unit including a drive output and an exhaust outlet, the pump jet comprising a rotor hub and a rotor carried thereby, the rotor hub being connected to the drive output of the power unit for selective rotation for forward or reverse motion, and the rotor hub having an internal passageway connected in fluid communication with the exhaust outlet, and an exhaust bypass movable between normal and bypassed positions, the exhaust bypass comprising an outer sleeve having a plurality of spaced apart exhaust windows therethrough and an inner sleeve having a plurality of spaced apart exhaust windows therethrough, the method comprising:

placing the exhaust bypass in the normal position so that the spaced apart exhaust windows are non-overlapping during for directing exhaust through the internal passageway of the rotor hub for discharging downstream of the rotor during forward motion; and placing the exhaust bypass in the bypassed position so that the exhaust windows are overlapping for bypassing exhaust from the internal passageway for discharging downstream of the rotor during reverse motion.

25. A method according to claim 24 wherein placing the exhaust bypass in the normal position comprises self-setting the exhaust bypass based upon rotation of the rotor hub for forward motion, and wherein placing the exhaust bypass in the bypassed position comprises self-setting the exhaust bypass based upon rotation of the rotor hub for reverse motion.

26. A method according to claim 24 wherein the outer sleeve is stationary, and further comprising rotating the inner sleeve for placing the exhaust bypass in the normal or bypassed position.

27. A method according to claim 26 wherein the outer sleeve includes at least one slot; and wherein the inner sleeve comprises at least one pin extending outwardly therefrom and into the at least one slot, and wherein placing the exhaust bypass in the normal or bypassed position is based upon rotation of the at least one pin in the at least one slot.

28. A method according to claim 26 wherein the power unit comprises a rotor shaft extending outwardly therefrom and through the exhaust bypass for engaging the rotor hub; the rotor hub including an outer end surface with a circular groove therein, and the inner sleeve including a circularly shaped protruding end that is received by the groove in the rotor hub, and wherein rotating the rotor hub causes the inner sleeve to rotate based upon a viscous friction therebetween.

29. A method according to claim 26 wherein the drive output comprises a rotor shaft extending outwardly from the power unit and through the exhaust bypass for engaging said rotor hub; said rotor hub further comprising a lever pivotally connected in the internal passageway thereof and having a first end engaging the inner sleeve, and wherein rotating the rotor hub causes the inner sleeve to rotate.

30. A method according to claim 29 wherein the lever has a second end, and wherein rotating the rotor hub above a predetermined speed causes the first end to disengage the inner sleeve.

31. A marine outboard motor comprising:

a power unit comprising a drive output and an exhaust outlet;

a pump jet comprising a rotor hub and a rotor carried thereby, said rotor hub connected to the drive output of said power unit for selective rotation for forward or reverse motion, said rotor hub having an internal passageway connected in fluid communication with the exhaust outlet, and an exhaust bypass movable between normal and bypassed positions, said exhaust bypass when in the normal position directing exhaust through the internal passageway of said rotor hub to discharge downstream of said rotor during forward motion, said exhaust bypass when in the bypassed position bypassing exhaust from the internal passageway to discharge downstream of said rotor during reverse motion;

a rotor housing enclosing said rotor hub, said rotor and said exhaust bypass; and a stator housing connected to said rotor housing and comprising a stator hub having an internal passageway connected in fluid communication with the internal passageway of said rotor hub.

32. A marine outboard motor according to claim 31 wherein said exhaust bypass is self-set to the normal position based upon rotation of said rotor hub for forward motion, and to the bypassed position based upon rotation of said rotor hub for reverse motion.

33. A marine outboard motor according to claim 31 wherein said exhaust bypass comprises:

an outer sleeve having a plurality of spaced apart exhaust windows therethrough; and an inner sleeve having a plurality of spaced apart exhaust windows therethrough;

said exhaust bypass being in the normal position when the spaced apart exhaust windows are non-overlapping, and being in the bypassed position when the exhaust windows are overlapping.

34. A marine outboard motor according to claim 33 wherein said outer sleeve is stationary, and said inner sleeve rotates for placing said exhaust bypass in the normal or bypassed position.

35. A marine outboard motor according to claim 34 wherein said outer sleeve includes at least one slot; and wherein said inner sleeve comprises at least one pin extending outwardly therefrom and into the at least one slot, said exhaust bypass being in the normal or bypassed position based upon rotation of said at least one pin in the at least one slot.

36. A marine outboard motor according to claim 34 wherein said drive output comprises a rotor shaft extending outwardly from said power unit and through said exhaust bypass for engaging said rotor hub; said rotor hub including an outer end surface with a circular groove therein, and said inner sleeve including a circularly shaped protruding end that is received by the groove in said rotor hub, and rotation of said rotor hub causes said inner sleeve to rotate based upon a viscous friction therebetween.

37. A marine outboard motor according to claim 34 wherein said drive output comprises a rotor shaft extending outwardly from said power unit and through said exhaust bypass for engaging said rotor hub; said rotor hub further comprising a lever pivotally connected in the internal passageway thereof and having a first end engaging said inner sleeve, and rotation of said rotor hub causes said inner sleeve to rotate.

38. A marine outboard motor according to claim 37 wherein said lever has a second end, and rotation of said rotor hub above a predetermined speed causes the first end to disengage said inner sleeve.

39. A marine outboard motor according to claim 37 wherein said lever is under compression so that the first end thereof engages said inner sleeve.

40. A marine outboard motor according to claim 31 further comprising a housing for carrying said power unit, said housing including a mounting plate extending above said pump jet; and wherein said stator housing further comprises a dorsal fin extending therefrom for securing said pump jet to said mounting plate.

41. A marine outboard motor according to claim 31 further comprising a housing for carrying said power unit, said housing including a mounting plate extending above said pump jet; and wherein said rotor housing further comprises a dorsal fin extending therefrom for securing said pump jet to said mounting plate.

42. A marine outboard motor according to claim 31 further comprising a housing for carrying said power unit, said housing including a skeg; and a clamp for securing said rotor housing to said skeg.

* * * * *

UNITED STATES PATENT AND TRADEMARK OFFICE

CERTIFICATE OF CORRECTION

PATENT NO. : 6,887,117 B2
DATED : May 3, 2005
INVENTOR(S) : Varney et al.

It is certified that error appears in the above-identified patent and that said Letters Patent is hereby corrected as shown below:

Column 11,
Line 35, delete “there from” insert -- therefrom for --.
Line 52, delete “during for” insert -- for --.

Signed and Sealed this

Sixth Day of September, 2005

JON W. DUDAS
*Director of the United States Patent and Trademark Office*